US006412924B1

(12) United States Patent
Ashe et al.

(10) Patent No.: US 6,412,924 B1
(45) Date of Patent: Jul. 2, 2002

(54) CERAMIC PIEZOELECTRIC INK JET PRINT HEADS

(75) Inventors: James Ashe, Basildon; Christopher David Phillips, Exning; Stuart Speakman, Chelmsford, all of (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 09/006,410

(22) Filed: Jan. 13, 1998

Related U.S. Application Data

(62) Division of application No. 08/604,983, filed as application No. PCT/GB94/01977 on Sep. 12, 1994, now Pat. No. 5,731,048.

(30) Foreign Application Priority Data

Sep. 14, 1993 (GB) ..... 9318985

(51) Int. Cl.[7] ..... B41J 2/045
(52) U.S. Cl. ..... 347/69
(58) Field of Search ..... 347/68–72, 45; 427/585, 586, 595, 58, 237, 249, 255.3, 294, 419.2

(56) References Cited

U.S. PATENT DOCUMENTS

| | | | | | |
|---|---|---|---|---|---|
| 4,678,680 | A | * | 7/1987 | Abowitz | 347/47 X |
| 4,890,126 | A | * | 12/1989 | Hotomi | 347/45 R |
| 5,016,028 | A | * | 5/1991 | Temple | 347/69 |
| 5,073,785 | A | * | 12/1991 | Jansen et al. | 347/45 |
| 5,119,116 | A | * | 6/1992 | Yu | 347/45 X |
| 5,598,196 | A | * | 1/1997 | Braun | 347/69 |
| 5,677,717 | A | * | 10/1997 | Ohashi | 347/69 |
| 5,729,261 | A | * | 3/1998 | Burke et al. | 347/45 X |
| 5,731,048 | A | * | 3/1998 | Ashe et al. | 427/585 |
| 5,900,288 | A | * | 5/1999 | Kuhman et al. | 427/534 |

FOREIGN PATENT DOCUMENTS

| | | | | |
|---|---|---|---|---|
| EP | 221724 | * | 5/1987 | |
| EP | 277703 | * | 8/1988 | 347/69 |
| EP | 278590 | * | 8/1988 | 347/69 |
| EP | 364136 | * | 4/1990 | 347/69 |
| WO | WO 93/17147 | * | 9/1993 | |
| WO | WO 95/11807 | * | 5/1995 | |

OTHER PUBLICATIONS

Carlson et al., "Ion–Plating Interior Nozzle Surfaces," IBM Technical Disclosure Bulletin, pp. 3117–3118, vol. 22, No. 8 (Jan. 1979).

Eldridge, et al., "Passivation of Silicon Ink Jet Structures," IBM Technical Disclosure Bulletin, p. 2520, vol. 23, No. 6 (Nov. 1980).

Harper, et al., "Quantitative Ion Beam Process for the Deposition of Compound Thin Films," American Institute of Physics, pp. 547–549, vol. 43, No. 6 (Sep. 15, 1983).

Manabe et al., "Silicon Nitride Films Prepared by the Electron Cyclotron Resonance Plasma Chemical Vapor Deposition Method," American Institute of Physics, pp. 2475–2480, vol. 66, No. 6 (Sep. 15, 1989).

B. Window et al., "Unbalanced dc magnetrons as sources of high ion fluxes," J. Vac. Sci. Technol. A 4(3), May/Jun. 1986, pp. 453–456, American Vacuum Society (1986).

* cited by examiner

*Primary Examiner*—Benjamin R. Fuller
*Assistant Examiner*—C Dickens
(74) *Attorney, Agent, or Firm*—Marshall, Gerstein & Borun

(57) ABSTRACT

A ceramic piezoelectric ink jet print head having at least one channel with walls coated with a multi-layer coating including an electronic barrier layer and an electrically conducting layer where the electric barrier layer is disposed between the channel well and the electrically conducting layer.

23 Claims, 3 Drawing Sheets

(PRIOR ART)
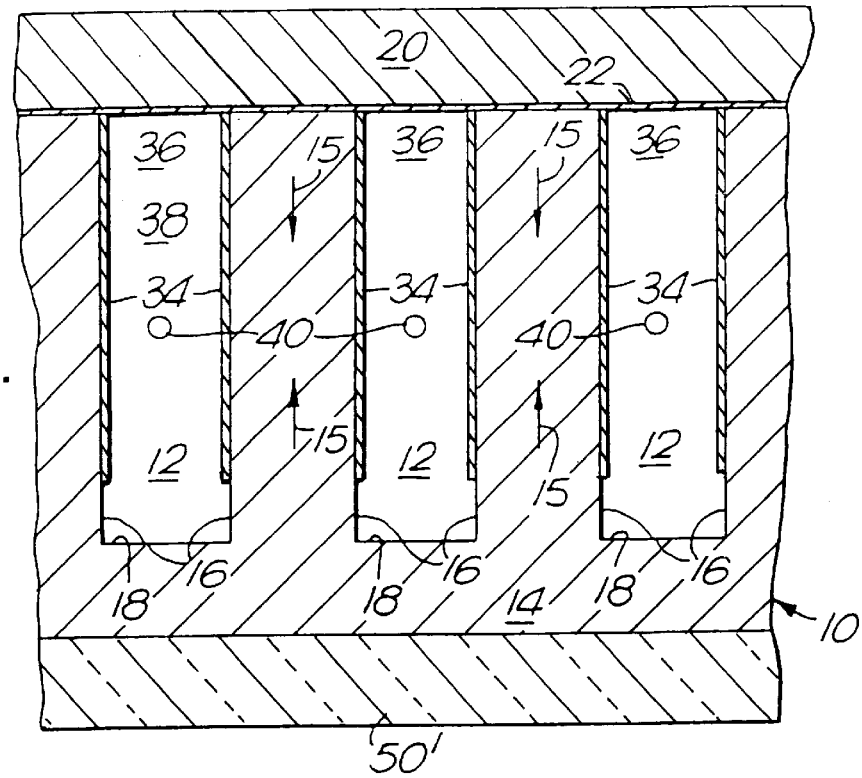
Fig.3.
Fig.4.
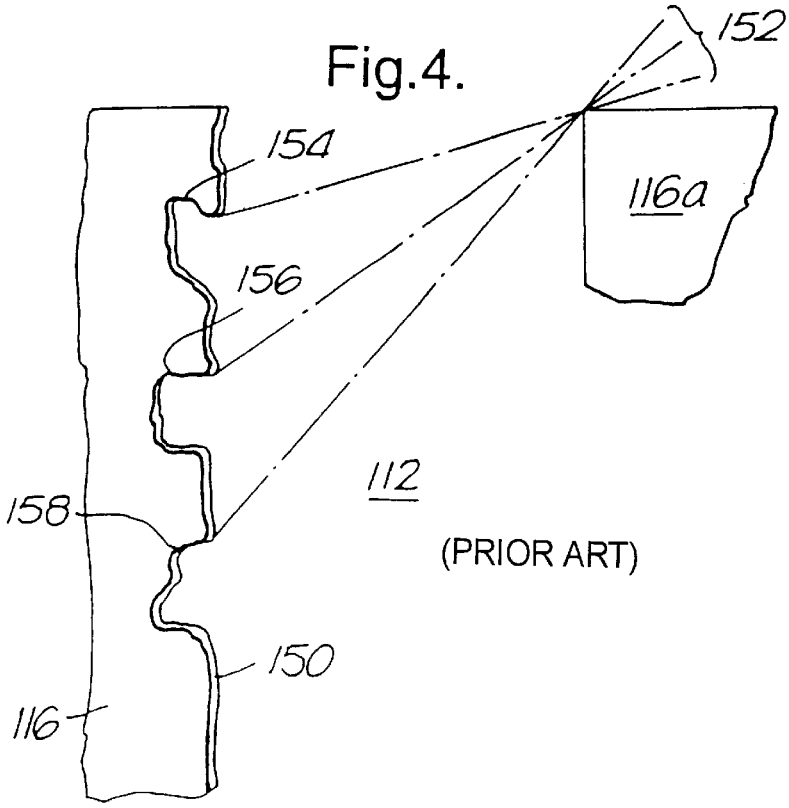
(PRIOR ART)

CERAMIC PIEZOELECTRIC INK JET PRINT HEADS

CROSS-REFERENCE TO RELATED APPLICATION

This is a division of U.S. application Ser. No. 08/604,983 filed Mar. 14, 1996, now U.S. Pat. No. 5,731,048 issued Mar. 24, 1998, which is the U.S. national phase of international Application No. PCT/GB94/01977 filed Sep. 12, 1994.

BACKGROUND OF THE INVENTION

This invention relates to improvements in or relating to ceramic piezoelectric ink jet print heads of the kind having an ink channel for connection to an ink ejection nozzle and to a reservoir for the ink, and a piezoelectric wall actuator which forms part of the channel and is displaceable in response to a voltage pulse thereby generating a pulse in liquid ink in the channel due to a change of pressure therein which causes ejection of a liquid droplet from the channel. Such print heads are referred to hereafter as piezoelectric ceramic ink jet print heads.

BRIEF DESCRIPTION OF THE DRAWINGS

Examples of such print heads as described, for example, in EP-A-277703, EP-A-278590 and EP-A-364136 are shown in FIGS. 1–3. FIG. 3 is a view similar to that of FIG. 1 showing another form of printhead.

Figure 1:
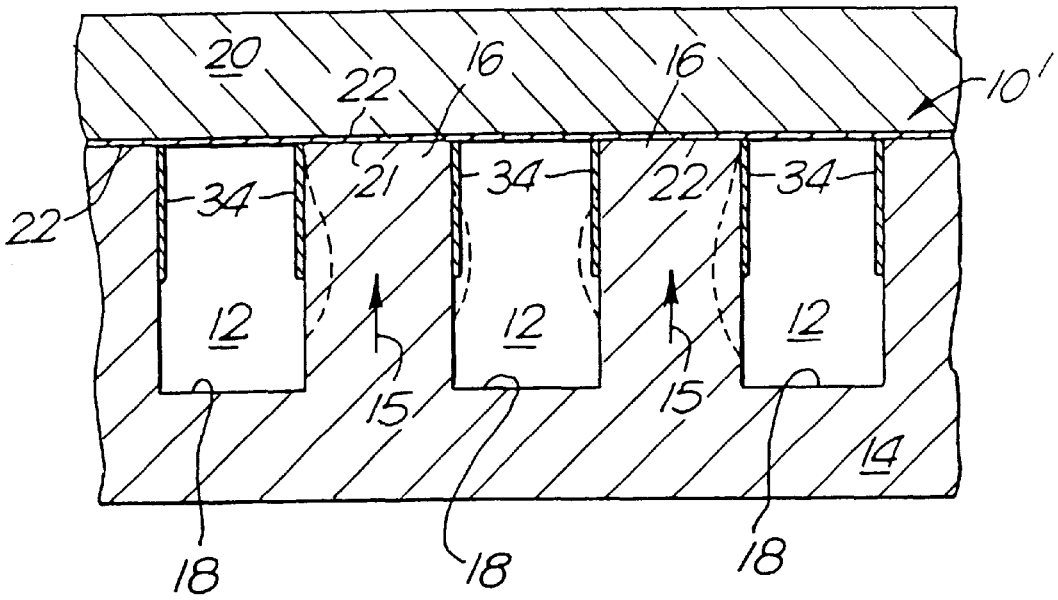
Fig.1. (PRIOR ART)
FIGS. 1 and 2 are different sectional views of the same ink jet printhead.

An enlarged view of a channel construction for which the teachings of the invention are particularly well suited is shown in FIG. 4. A portion of the channel of FIG. 4 is illustrated in FIGS. 5–8 including various examples of multi-layer coatings after being deposited according to the teachings of the present invention.

One form of ink jet printhead 10 comprises a multiplicity of parallel ink channels 12 forming an array in which the channels are mutually spaced in an array direction perpendicular to the length of the channels. The channels are formed at a density of two or more channels per mm. in a sheet 14 of piezoelectric material, suitably PZT, poled in the direction of arrows 15 and are defined each by side walls 16 and a bottom surface 18, the thickness of the PZT being greater than the channel depth. The side walls 16 are generally at an angle of no more than 10° from the normal to the bottom wall. The channels 12 are open topped and in the printhead are closed by a top sheet 20 of insulating material which is thermally matched to the sheet 14 and is disposed parallel to the surfaces 18 and bonded by a bonding layer 21 to the tops 22 of the walls 16. The channels 12 on their side wall surfaces are lined with a metallised electrode layer 34. It will be apparent therefore that when a potential difference of similar magnitude but opposite sign is applied to the electrodes on opposite faces of each of two adjacent walls 16, the walls will be subject to electric fields in opposite senses normal to the poling direction 15. The walls are in consequence deflected in shear mode.

Figure 2:
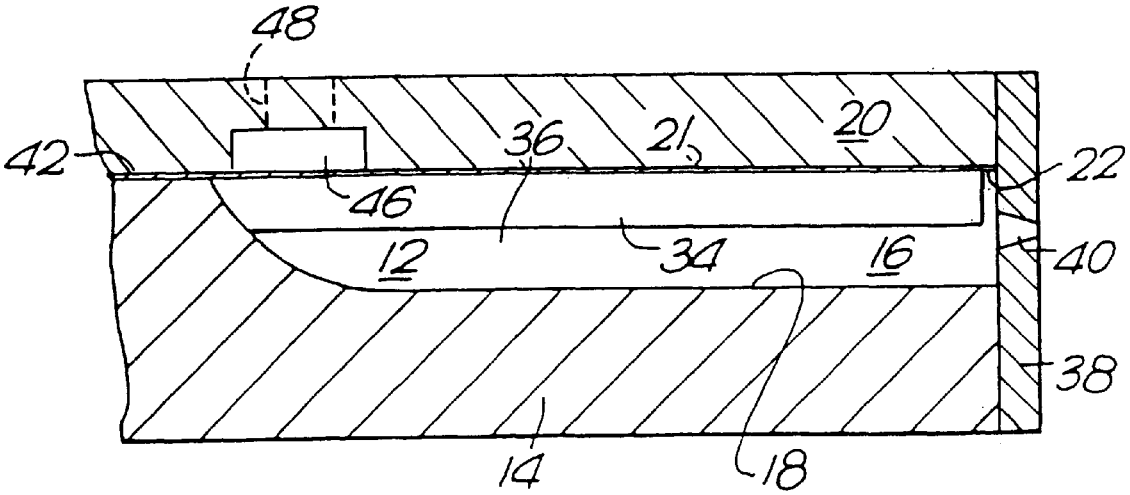
Fig.2. (PRIOR ART)

Referring now to FIG. 2, the channels 12 therein are provided on facing walls 16 thereof with metallised electrodes 34 which extend from the edges of the tops 16 of the walls down the walls to a location well short of the bottom surface 18 of the channels. There is an optimum metallisation depth which gives maximum wall displacement at about the mid-height of the walls depending on the distribution of wall rigidity. In this form the walls are of the so-called cantilever type.

In FIG. 2, it will be seen that the channels 12 comprise a forward part 36 of uniform depth which is closed at its forward end by a nozzle plate 38 having formed therein a nozzle 40 from which droplets of ink in the channel are expelled by activation of the facing actuator walls 16 of the channel. The channel 12 rearwardly of the forward part 36 also has a part 42 of lesser depth extending from the tops 22 of the walls 16 than the forward part 36. The metallised plating 34 which is on opposed surfaces of the walls 16 occupies a depth approximately one half that of the channel side walls but greater than the depth of the channel part 42 so that when plating takes place the side walls 16 and bottom surface 18 of the channel part 42 are fully covered whilst the side walls in the forward part 36 of the channel are covered to approximately one half the channel depth in that part. One suitable electrode metal used is an alloy of nickel and chromium, i.e. nichrome. Alternatively, aluminium provides a high conductivity electrode and the metal track in the part 42 is suitable for applying a wire bond connection. Aluminium in particular requires to be coated with a layer of passivation to inhibit electrolysis and bubble formation or corrosion which could occur if the electrode is in direct contact with the ink.

It will be noted that a droplet liquid manifold 46 is formed in the top sheet 20 transversely to the parallel channels 12 which communicates with each of the channels 12 and with a duct 48 which leads to a droplet liquid supply (not shown).

In the arrangement shown in FIG. 3, wherein elements common with the embodiment of FIGS. 1 and 2 are identified by the same reference numerals as in FIGS. 1 and 2, a sheet 14 is employed therein having upper and lower regions poled in opposite senses as indicated by the arrows 15. A sheet 50' of glass or other insulating material is employed as a stiffening means for the sheet 14 of piezoelectric material. The electrodes 34 are deposited so as to cover the facing channel side walls from the tops thereof down to a short distance from the bottoms of the channels so that a region of each side wall extending from the top of the channel and poled in one sense and a substantial part of a lower region of the side wall poled in the reverse sense are covered by the relevant electrode. Thus, it will be appreciated that the arrangement described operates to deflect the channel side walls into chevron form. Other forms of ink jet printhead having an array of ink channels separated by piezoelectric wall actuators described in the art are also suitable for the application of the process of this invention.

The invention is concerned with passivation of the walls of the channels; that is, the deposition of a protective layer on the walls by coating. The purpose of the passivation is to provide a coating acting as an electron or ion or ink barrier and therefore to protect the channel walls from attack by the ink and/or to protect the ink from the channel walls. Protection of the channel walls from the ink is particularly desirable where the ink is aqueous or otherwise electrically conductive.

Where—as is the case in the example given above—the channel includes opposed walls comprising piezoelectric ceramic material and is provided with electrodes for connection to voltage pulse generating means, passivation is particularly desirable to protect the electrodes from the ink and also to insulate the ink from the electrodes, and more particularly the fields generated by the electrodes, especially where the ink is a dispersion. In one embodiment of this form of ink jet print head, the channels are formed with opposed side walls and a bottom wall all of piezoelectric ceramic material, e.g. by cutting or machining an open channel from a block of the material, and a top wall which closes the channel. In this embodiment, in general the side walls and bottom wall are passivated.

IBM Technical Disclosure Bulletin, Vol. 23, No. 6, November 1980, page 2520 discloses a method for passivation of an ink jet silicon nozzle plate whereby a first overcoat of thermal $SiO_2$ is applied to a silicon substrate followed by a second overcoat of glow discharge silicon carbon. Formation of the first overcoat generally entails substrate temperatures of the order of 900° C.

EP-A-0 221 724 discloses an ink jet printer nozzle having a substrate of silicon or glass and a coating resistant to corrosion by aqueous and non-aqueous inks. The coating comprises respective layers of silicon nitride, silicon nitride with aluminium nitride, and aluminium nitride. Sputtering, Chemical Vapour Deposition (CVD) and evaporation are given as suitable techniques for forming the coating. Typical substrate temperatures are given as 700–800° C. and, as described, ion-assisted deposition is a line-of-sight coating process.

U.S. Pat. No. 4,678,680 discloses the use of an ion beam implanting device to implant ions in the aperture plate of an ink jet printer of the continuous stream type, thereby improving the corrosion resistance of the aperture plate.

IBM Technical Disclosure Bulletin, Vol. 22, No. 8, January 1979, page 3117 discloses a method of depositing a coating material such as titanium on to the bore of a nozzle using ion plating. This method relies on resputtering of that coating material initially deposited near the mouth of the bore of the nozzle so as to achieve coating further inside the bore.

Achieving the substantially continuous coating of the channel walls of a ceramic piezoelectric printhead that is required for effective passivation gives rise to particular problems, however. One problem is that certain areas of especially the lower parts of the side walls of a channel cannot readily be coated by procedures which require line-of-sight between the coating source and the surface to be coated because, when the source is appropriately located relative to the channel for deposition of a layer on a side wall, these lower parts will be in the shadow of the upper part of the opposite wall. Moreover, this problem increases with the depth of the channel relative to its width (referred to hereafter as the "aspect ratio" of the channel).

Another problem particular to this type of ink jet printhead is caused by the granular structure of the piezoelectric material from which the printhead is made: grain-cluster pull-out occurs to a greater or lesser extent during formation of the channel, leaving walls having microscopic crevices, undercuts and overhangs.

These problems may be understood more clearly by reference to FIG. 4 which is a very much enlarged view of a channel 112 defined by walls 116 and 116*a*. The coating of the surface 150 of the wall 116 using conventional line-of-sight deposition procedures such as ion implantation or ion plating, which require line of sight 152 between the coating source and the surface to be coated, is not possible. It is likewise impossible to coat undercut zones such as 154, 156 and 158 even though they are not shadowed by the opposite wall 116*a* of the channel. Consideration of the geometry will also show that this second problem becomes even more acute with increase in the aspect ratio of the channel; that is, the ratio of the depth of the channel to its width: the greater the aspect ratio, the more acute is the maximum possible angle between (a) the line of sight be between the source and the channel bottom and (b) the plane of the channel wall, and thus the greater the area of undercut that is placed in shadow by the overhang above. Such acute angles also present problems in achieving a uniform and continuous coating over the walls and channel bottom since the capture efficiency of coating materials varies with the angle of incidence.

Yet another problem is caused by the manner of construction of ceramic piezoelectric ink jet printheads of the type mentioned at the beginning of the description: the configuration of the electrodes, which are arranged so as to generate an electric field perpendicular to the direction of polarisation of piezoelectric material thereby to displace the piezoelectric wall actuators in shear mode makes it very difficult if not impossible to perform any subsequent repoling of the piezoelectric material once passivation has taken place. Furthermore, ink jet print heads of the type in question are preferably made from a high activity piezoelectric ceramic having a Curie temperature (i.e. the temperature $T_c$ at which the material is no longer capable of retaining polarisation) of the order of 150° C. to 250° C. The coating process should be performed at a lower temperature, suitably 50° C. to 100° C. below the Curie temperature, to avoid accelerated aging or depoling of the piezoelectric material. The use of conventional chemical vapour deposition or plasma-enhanced chemical vapour deposition coating procedures, which generally employ temperatures substantially in excess of 200° C., e.g. 300° C. or 500° C. or even more, therefore necessitates repolarisation following passivation if printhead activity (and hence efficiency) is not to be lost. To avoid repolarisation following passivation, a coating process temperature of less than 200° C., and preferably not more than 100° C., is required, the lower temperatures permitting the use of more active materials.

SUMMARY OF THE INVENTION

At lower temperatures, either coating is not achievable at all with these procedures or it is only achievable at an unacceptably slow rate and in any event there is another problem which is that coating thicknesses tend to decrease from top to bottom of the channel and thus under the conditions required to achieve the desired thickness of coating towards the bottom of the channels, the deposition of coatings of excessive thickness at the top is unavoidable, and as the tendency for the coatings to have defects such as unrelieved internal stresses increases with thickness, the risk of obtaining a defective coating is increased. This problem becomes particularly acute where the channel has an aspect ratio of more than 2:1, e.g. 3:1 or more. For example, for some channels where the aspect ratio is 4:1 or more, coating thicknesses of as much as one half or one micron may be found in the upper parts of the channel under the conditions required to achieve a desired coating thickness of 50–100 nm lower down. Channels having an aspect ratio of 3:1 or more are hereafter referred to as deep channels.

The present invention aims to solve the above problems.

According to the present invention, there is provided a process for the passivation of the channel walls of a deep channel ink jet print head channel of ceramic piezoelectric material by the deposition of a coating comprising inorganic material, the process comprising:

(a) providing an ink jet print head component containing said channel and (b) while maintaining the bulk temperature of the actuating component which contains said channel at a temperature of below 200° C. and at which not more than 30% depolarisation of the material occurs during passivation, exposing the surface of the channel walls to be passivated to a homogenised vapour of the coating material, said vapour having undergone multiple scattering during transport thereof from the source of the vapour to said surface.

By a homogenised vapour, we mean that the chemical constituents of the vapour used by the process have a substantially uniform distribution, so that the coating deposited approaches and preferably attains chemical homogeneity in the surface layer.

DETAILED DESCRIPTION OF THE INVENTION

By multiple scattering, we mean at least 2 and preferably at least 3 scattering events. The vapour atoms are then substantially homogenised in the sense that the energy and incident angle of the vapour atoms on the surface is substantially randomised. If less than one collision (scattering event) occurs, the process is substantially line of sight whereas if more than 3 collisions occur only a small fraction of atoms arrive directly from the source. On the other hand, if the number of scattering events is too high, the vapour is in effect thermalised and thus it is preferred that the number of collisions does not exceed 8 or 9 and more preferably does not exceed 6.

While kinetic modelling is in general too complex to simulate the interactions that contribute to the required coating distribution and quality in deep channels, it is believed that some degree of surface scattering of incident species from one side of the channel to the other side of the channel takes place and this helps to equalise the coating thickness from top to bottom of the channels. As the coating thickness builds up, surface mobility and forward sputtering promoted by the incident flux, for example of ionised species under the bias field, also contribute to equalise the coating thickness and to covering hidden features in the surface. It is believed that the species is capable of migration on the surface due to surface mobility with a range typically exceeding 1 micrometre and that the range increases as the layer of densified coating develops. The range can be varied by changing both the proportion of ionised species in the vapour and their incident energy. Both transport of coating material down the surface of the wall in the channel and spreading of material over the surface roughness features therefore occur during the process.

While the process is applicable to any deep channel ink jet print head it finds particular application to multi-channel print head channels particularly those containing electrodes and especially those wherein the actuating component containing the channel is polarised in a direction substantially parallel to the planes of the channel walls, as in, for example, print heads having actuators of the so-called chevron or cantilever type.

In one preferred embodiment, which assists in reducing the risk of including defects such as unrelieved internal stresses, the coating is formed by depositing a plurality of layers. These layers may be deposited from vapours having the same composition, which assists retaining chemical homogeneity of the coating throughout its thickness or, as discussed in more detail below, they may be derived from vapours of differing chemical compositions or from a vapour whose chemical composition is varied during the period of deposition of the coating.

An acceptable coating rate while avoiding induced stress is achieved by operation at high pressure, for example a pressure up to 200 mtorr (millitorr) but preferably not lower than 0.1 mtorr. If a pressure above 200 mtorr is used the atoms arrive at the surface having lost too much energy and the material quality is therefore poor. On the other hand, if the pressure is less than 0.1 mtorr, the number of scattering events in the vapour during transport from the source to the surface may become inadequate and the process may become "line of sight". A preferred range is 1 to 50 mtorr and the choice of pressure will depend inter alia on the distance between the source and the substrate, the nature of the process gases and the temperature of the vapour.

Examples of suitable deposition methods are chemically reactive deposition methods wherein the surface mobility of the layer-forming species is raised above the level predicated by the surface temperature; that is to say, methods which raise the surface mobility of the layer-forming species by non-thermal means. Particular examples of such methods include electron cyclotron resonance (ECR)-assisted CVD e.g. as described in J.Applied Physics 66, No 6, pages 2475–2480, and reactive unbalanced magnetron sputtering (UMS) such as described in J.Vacuum Sciences Technology 4, No 3, pages 452 on. No applied heat is required with these techniques and thus the risk of depoling and/or ageing the piezoelectric ceramic material is minimised. Also by means of these methods, a continuous coating can be obtained even in those areas shaded from the sources of the layer-forming species e.g. due to overhang or surface roughness. Another suitable process is UV photon assisted CVD. A further involves the use of organometallic precursors in a CVD process.

While not essential to the process, it has been found advantageous to apply a bias voltage. It has been observed for example, that this may increase the rate of deposition and/or the rate of deposition on the lower parts of the side walls of the channels relative to the upper parts and/or may improve the quality of the deposited layer, e.g. its physical and/or electrical properties. Good results have been obtained at bias voltages of up to −300 v (target against ground) and even higher voltages may be found suitable in some cases. However, other conditions such as current level, should be chosen to avoid problems such as sputtering of the layer being deposited and/or damage of the PZT by induced heating. It will also be understood that there may be a relationship between the operating temperature and the bias voltage in that the use of higher bias voltages may require a reduction in the bulk temperature of the actuator to avoid inadvertent depoling, and vice versa.

It has been found that the optimum bias may vary with the nature of the layer being deposited and thus the passivation of the wall of a piezoelectric ceramic ink jet print head channel by building up the desired coating thickness by depositing a plurality of layers by chemically reactive deposition, or other method involving charged species, may be enhanced by the application of a bias voltage and varying the level of bias voltage according to the nature of the layer e.g. to minimise the level of stress in each of the deposited layers.

In order to achieve a strong bond between the coating and the substrate, it is desirable for the vapour to which the surfaces to be coated are exposed to have an energy at the surface of at least 1 eV if a surface catalytic effect is present or at least 5 eV if there is no catalytic effect. At these energy levels, chemical bonding is encouraged whereas at lower levels, the bonding will be mainly physical. However, at high energy levels, the substrate and/or the coating may be damaged and it is therefore not advisable for energy levels to exceed 500 eV, and preferably they are below 300 eV and more preferably below 100 eV. Whereas a range of 5 to 25 eV, and more particularly 12 to 20 eV, is expected to be appropriate for most circumstances to develop a dense coating layer, higher energies, depending on the vapour are useful to promote transport and spreading of the layer-forming species.

Two or more than two layers may be deposited by the process of the invention and the layers may be of the same composition; however a particular advantage of the process is that layers of different composition may be deposit. The thickness of the various layers may also be varied, thereby providing the operator with a very versatile tool for achieving particular properties and combinations of properties in the coating, e.g. in terms of resistivity, ion barrier properties and water permeability. One particular advantage arises from the observation that the rate at which a layer is deposited depends on its composition. Thus, the rate at which a coating with a particular overall thickness and particular properties is obtained can be increased by first depositing a layer having a higher rate of deposition followed by a further layer having the composition having the desired properties.

Any material capable of being deposited by the process of the invention may be employed in the formation of the layers making up the passivation multilayer coating. The material may comprise an element, e.g. as in carbon or a metal, or it may be a combination of two or more elements as in a metal alloy or a compound. (By a "compound" we mean here a combination of two or more elements whether in the ratios dictated by their valencies or not). This is because where a compound is deposited it has been found that the ratios of the elements in the deposited layer may be varied from those strictly expected from their respective valencies and that these ratios can be controlled by control of the process conditions in known manner. Thus, for example, a layer of silicon and carbon may be deposited wherein the ratio of Si to C is other than 1:1; moreover, the ratio may be varied, if desired, as the layer is deposited.

Examples of layers that may be deposited include carbon (both amorphous and diamond-like), silicon-oxygen (SiO), silicon-nitrogen(SiN), silicon-oxygen-nitrogen (SiON), silicon-carbon (SiC), aluminium-nitrogen (AlN), silicon-aluminium-nitrogen (SiAlN), aluminium-oxygen (AlO), aluminium-silicon-oxygen (AlSiO) and silicon-aluminium (SiAl).

It is to be understood that the symbolic representations of elemental combinations given in brackets in the preceding sentence are not intended to be indicative of any specific stoichiometric ratios, and that the deposited layers may comprise stoichiometric, non-stoichiometric and/or doped combinations of the indicated elements. For example a layer referred to as an SiO layer may contain Si and O atoms in a ratio of 1:2 or in different ratio and a layer referred to as an SiN layer may contain Si and N atoms in a ratio of 3:4 or in a different ratio.

Figure 5:
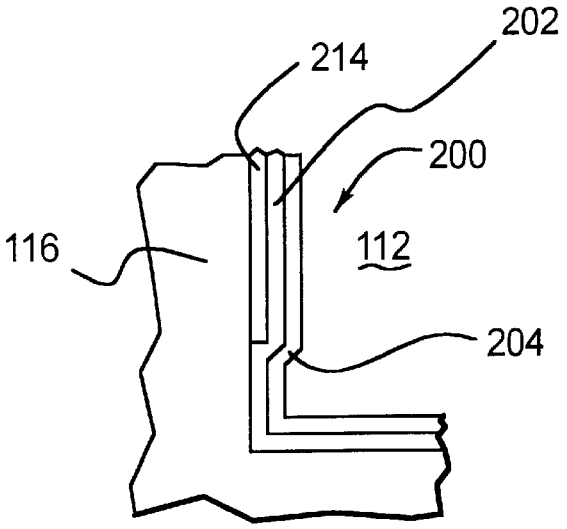

The materials employable as sources for the elements employed in the formation of such layers by CVD are known; for example silanes may be employed as a source of silicon, hydrocarbons as a source of carbon, and ammonia, and oxides of nitrogen, as well as nitrogen itself, as a source of nitrogen. H and/or O atoms from unavoidable water vapour impurity may also be included in the layers. For example, SiN layers may also contain hydrogen and/or oxygen atoms. SiO layers may also be found to contain nitrogen atoms.

Where the ink jet print head is intended for use with an ionisable ink it is desirable for the passivation layer to comprise both an electron barrier and an ion barrier but it may be difficult to contrive a single material that efficiently provides both these properties. Thus, a preferred multi-layer 200 arrangement is shown in FIG. 5 and includes at least one electron barrier layer 202 and at least one ion barrier layer 204. Thus in one preferred embodiment there is provided by the process of the invention a passivated ceramic piezoelectric ink jet print head channel 112 wherein the passivation comprises at least one layer of material which provides an ion barrier, preferably SiN, and at least one layer of material which provides an electron barrier, preferably SiO. Preferably a layer of electron barrier material 202 is located between the channel wall 116 and a layer of ion barrier material 204.

In general, it will be desirable for the electron barrier layer to have a resistivity of at least $10^{13}$ ohm.cm and for the ion barrier layer to pass an ion current not greater than $1nA/cm^2$ at an applied field of 10V/micron. It is also generally preferable that the ion barrier layer does not break down under fields of less than 10V/micron and more preferably 30V/micron.

In another preferred embodiment, the passivation multilayer includes the layer structure $SiO/SiN/SiO(SiN/SiO)_x$ where x is zero or a positive integer, and with the first SiO layer nearest the channel wall.

Figure 6:
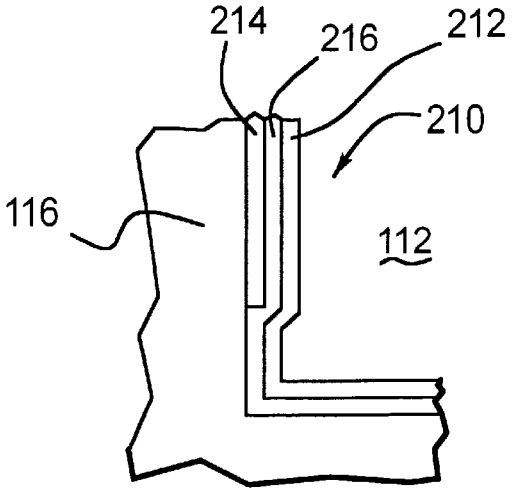

In a further preferred embodiment shown in FIG. 6, a passivation multilayer 210 may include a conducting layer 212 electrically insulated from the channel wall 116 (or more particularly from the electrodes 214 associated with the channel 112) by another layer 216 of the multilayer. Such a conducting layer 212 may provide the effect of a Faraday's cage the presence of which is advantageous since it enables ink in the channel 112 to be protected from electric fields emanating from the channel electrodes 214. This is particularly important where the ink is a dispersion.

It also assists in confining to the channel sidewalls stray electric fields emanating from the electrodes, thereby reducing the risk of piezoelectric cross-talk between channels in a multi-channel array.

Thus, according to yet a further aspect of the invention there is provided a ceramic piezoelectric ink jet print head channel the walls of which are passivated and the passivation includes a conducting layer electrically insulated from the channel walls by another layer and providing a Faraday's cage effect.

In a preferred embodiment of this aspect of the invention, the conducting layer is provided in a multilayer arrangement between the channel wall (and in particular the electrodes associated with the channel) and a layer of ion barrier material. By means of this embodiment this layer of ion barrier material is protected from the electromagnetic fields emanating from the channel electrodes.

Figure 7:
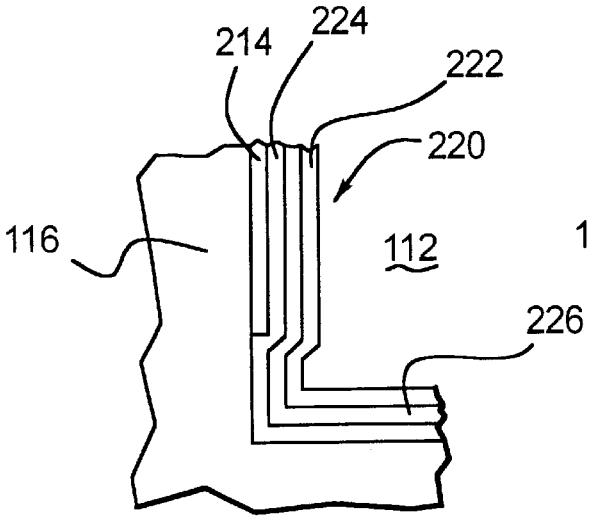
Figure 8:
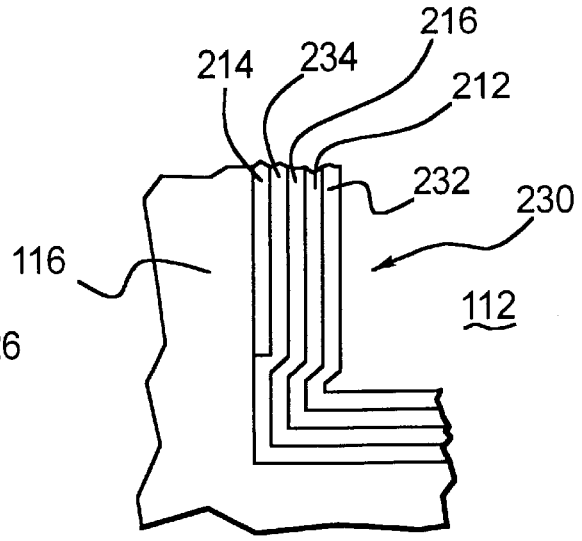

A particularly preferred embodiment of this aspect of the invention shown in FIG. 7 comprises a passivation multilayer 220 comprising at least one ion barrier layer 222, at least one electron barrier layer 224 and a conducting layer 226, with the electron ion barrier layer 224 (i.e. insulation) located between the channel wall 116 (electrode 214) and the conducting layer 226 and an ion barrier layer 222 on the other side of the conducting layer 226, ie. between the conducting layer and the ink (not shown).

Alternatively, if the conducting layer insulated from the channel electrodes is in contact with the ink, it may be used to control the potential of the ink independently of the electrode potential during actuation. This may assist to control the charge carried by ink drops ejected from the print head as described in British patent application 93:22203.2.

Any suitable material may be employed for the conducting layer and while it is advantageous, from the point of view of simplifying the equipment employed to produce the passivation multilayer, for the material to be such that the layer is obtainable by CVD, this is not essential. Examples of suitable materials are metals, including alloys; however particularly preferred are silicon carbide (SiC) and carbon since an apparatus designed to produce the preferred ion and electron barrier materials of SiN and SiO may readily be adapted to produce layers of SiC and/or carbon e.g. using a hydrocarbon such as methane as the carbon source.

Carbon is a particularly noteworthy material for one or more layers of the multilayer passivation since according to the deposition conditions employed it may be deposited either as an insulating layer (e.g. diamond-like carbon) or as a conducting layer (e.g. amorphous carbon).

Thus according to another preferred embodiment of this aspect of the invention, a conducting layer of the passivation multilayer comprises electrically conductive carbon, e.g. amorphous carbon, and preferably such passivation multilayer also includes an electrically insulating carbon layer, e.g. diamond-like carbon.

Another preferred embodiment comprises a passivation multilayer including an electrically insulating carbon layer, e.g. diamond-like carbon and preferably also an electrically conducting carbon layer, e.g. of amorphous carbon.

As indicated above, the composition of a layer may be varied as it is deposited. Thus, for example, in the deposition of an SiN layer, the ratio of Si:N may be altered during the course of the deposition. Likewise, for example, if an SiN layer is to be followed by an AlN layer, the process may be controlled so that the ratio of Si:Al is varied from 100:0 to 0:100, thereby giving an intermediate zone containing Si—Al—N between Si—N and Al—N. The variation of the composition may be continuous or stepwise.

The channel walls of the deep channel to which the process of the present invention may be applied may be of any piezoelectric ceramic material. Examples include both crystalline ceramic materials such as gadolinium molybdate (GMO) and Rochelle salt, and polycrystalline ceramic materials such as lead zirconate titanate (PZT) and related piezoelectric perovskite ceramics. Specific examples include Motorola HD 3203 ($T_c$=260° C.), Sumitomo HD5 ($T_c$=205° C.) or Tokin N-10 ($T_c$=165° C.).

The invention is now illustrated by the following Examples which involve the coating of a PZT ink jet print head channel having parallel side walls and a bottom wall, and a width of 90 $\mu$m and a depth of 500 $\mu$m.

In a first experiment to show the benefits of LTCRD, passivation was deposited with no applied heat, using an Astex ZX4400 ECR-CVD source. A chamber pressure of 1–5 millitorr, back filled with 5% silane in argon and nitrogen with no applied bias, was used to deposit a single nitride layer. The distance between the source and the substrate was about 6× the mean free path of the vapour mixture. The thickness of the layer at the bottom of the sidewalls was found to be 19% of the thickness on the top horizontal surface, compared with only 14% using plasma enhanced CVD. In a second experiment with bias exceeding −50V, the bottom layer thickness increased to 28%. The thickness at the top of the walls in each case is approximately 50%. Thus a desired minimum thickness can be achieved at the bottom of the sidewall with a lower thickness of material at the top of the sidewall. This not only reduces the likelihood of stress in the layer, but also shortens the deposition time. Moreover, the plasma enhanced CVD process required a temperature of 300° C. which is substantially above the maximum tolerable temperature for processing most PZT materials without the risk of depoling. Analysis of the material revealed a hydrogen content of less than 12 at %, and a buffered HF etch rate (7:1 dilution) of less than 25 Ångströms.min$^{-1}$. The coating exhibited excellent adhesion to the PZT, no exfoliation and no observed crack sites. The coating had a resistivity of greater than $10^{13}$ Ohms.cm at 10 KHz, a series resistance of about $10^9$ Ohms, and a dielectric constant of 7 (at 1 MHz and 50 mV).

In a third experiment, a 1.1 $\mu$m thick passivation coating, (measured by ERDA on the horizontal top surface) was formed using ECR-CVD apparatus with an applied bias of up to −150V. The coating comprised a plurality of layers as follows: (PZT)/SiO/SiN/SiO/SiN/(Air). The gases used to form the SiO layers were 5% silane in argon, and nitrous oxide. The layers were substantially $SiO_2$, with less than 10% atomic hydrogen. The gases used to form the SiN layers were 5% silane in argon and nitrogen. The layers were substantially a-$Si_3N_4$:H, with less than 20% atomic hydrogen. The coating had excellent adhesion to the PZT with no stress cracking, and was not removed by the Sellotape test.

In similar fashion, multilayer passivation coatings of the following structure could be obtained.

(PZT)/SiO/SiC/SiN/(Air)

(PZT)/SiO/amorphous carbon/(Air)

(PZT)/diamond-like carbon/amorphous-like carbon/(Air)

The SiO layers, which were substantially $SiO_2$, with less than 10% atomic hydrogen, were derived as described above. The SiC layer was derived from 5% silane in argon and methane.

The SiN layer, which was substantially a-$Si_3N_4$:H with less than 20% atomic hydrogen was derived as described above. The amorphous and diamond-like carbon layers were obtained using methane and argon.

What is claimed is:

1. A ceramic piezoelectric ink jet printhead comprising at least one channel having channel walls and electrodes on the walls, wherein the walls and electrodes have been coated with a multi-layer coating comprising an electron barrier layer and an electrically conducting layer and wherein the electron barrier layer is between the channel wall electrodes and the electrically conducting layer.

2. A ceramic piezoelectric ink jet printhead as claimed in claim 1 in which said print head channel includes electrodes.

3. A ceramic piezoelectric ink jet print head as claimed in claim 2 wherein an actuating component contains said channel and comprises piezoelectric ceramic and operates in shear mode.

4. A ceramic piezoelectric ink jet printhead as claimed in claim 3 in which said actuating component containing said channel is polarized in a direction substantially parallel to the planes of the channel walls.

5. A ceramic piezoelectric ink jet printhead as claimed in claim 1 wherein the material of the electrically conducting layer is selected from the group consisting of amorphous carbon and silicon-carbon.

6. A ceramic piezoelectric ink jet printhead as claimed in claim 1 wherein the material of the electron barrier layer is selected from the group consisting of silicon-oxygen and diamond-like carbon.

7. A ceramic piezoelectric ink jet printhead as claimed in claim 6, wherein the electrically conducting layer comprises amorphous carbon and the electron barrier layer comprises diamond-like carbon.

8. A ceramic piezoelectric ink jet printhead as claimed in claim 1, wherein the electrically conducting layer is in contact with the ink.

9. A ceramic piezoelectric ink jet printhead as claimed in claim 1, wherein the multilayer coating comprises an ion barrier layer outside the conducting layer.

10. A ceramic piezoelectric ink jet printhead as claimed in claim 9, wherein the ion barrier layer comprises silicon-nitrogen.

11. A ceramic piezoelectric ink jet printhead as claimed in claim 1, wherein the multilayer coating comprises a water-impermeable layer.

12. A ceramic piezoelectric ink jet printhead as claimed in claim 11, wherein the material of the water-impermeable layer is selected from the group consisting of aluminium oxide, diamond-like carbon and aluminium nitride.

13. A ceramic piezoelectric ink jet printhead as claimed in claim 1, wherein the multi-layer coating comprises an under-layer to assist adhesion of the remaining layers of the coating to the channel wall.

14. A ceramic piezoelectric ink jet printhead as claimed in claim 1 wherein the coating is effected by electron cyclotron-assisted chemical vapor deposition, reactive unbalanced magnetron sputtering or UV photon assisted chemical vapor deposition.

15. A ceramic piezoelectric ink jet printhead comprising channels having channel walls with electrodes, the channel walls and electrodes being coating with a multi-layer coating comprising an electrically conducting layer and an ion barrier layer, and wherein the electrically conducting layer is between the channel wall electrodes and the ion barrier layer, thereby protecting the ion barrier layer from electromagnetic fields emanating from the channel wall electrodes.

16. A ceramic piezoelectric ink jet printhead as claimed in claim 13 wherein the material of the electrically conducting layer is selected from the group consisting of amorphous carbon and silicon-carbon.

17. A ceramic piezoelectric ink jet printhead as claimed in claim 15, wherein the ion barrier layer comprises silicon-nitrogen.

18. A ceramic piezoelectric ink jet printhead comprising at least one channel having walls and electrodes on the walls, wherein the walls and electrodes are passivated, the passivation including an electrically conducting layer electrically insulated from the channel wall electrodes by another layer.

19. A ceramic piezoelectric ink jet printhead comprising at least one channel having walls and electrodes on the walls, wherein the walls and electrodes have been coated with a multi-layer coating comprising an electron barrier layer, an electrically conducting layer, and an ion barrier layer, and wherein the electron barrier layer is between the channel wall electrodes and the conducting layer, and the ion barrier layer is outside the conducting layer.

20. A ceramic piezoelectric ink jet printhead as claimed in claim 19 wherein the material of the electrically conducting layer is selected from the group consisting of amorphous carbon and silicon-carbon.

21. A ceramic piezoelectric ink jet printhead as claimed in claim 19 wherein the material of the electron barrier layer is selected from the group consisting of silicon-oxygen and diamond-like carbon.

22. A ceramic piezoelectric ink jet printhead as claimed in claim 21, wherein the multi-layer coating comprises an electrically conducting layer of amorphous carbon and an electron barrier layer of diamond-like carbon.

23. A ceramic piezoelectric ink jet printhead as claimed in claim 19, wherein the ion barrier layer comprises silicon-nitrogen.

* * * * *

UNITED STATES PATENT AND TRADEMARK OFFICE

CERTIFICATE OF CORRECTION

PATENT NO. : 6,412,924 B1
DATED : July 2, 2002
INVENTOR(S) : Ashe et al.

It is certified that error appears in the above-identified patent and that said Letters Patent is hereby corrected as shown below:

Column 11,
Line 32, please change “13” to -- 15 --.

Signed and Sealed this

Twenty-seventh Day of May, 2003

JAMES E. ROGAN
*Director of the United States Patent and Trademark Office*